US006962031B2

(12) United States Patent
Clarke et al.

(10) Patent No.: US 6,962,031 B2
(45) Date of Patent: Nov. 8, 2005

(54) DOORS

(75) Inventors: Nicholas Guy Clarke, Cheshire (GB); Ernest Kenneth Hammond, Cheshire (GB)

(73) Assignee: Polymer Doors Limited, Cheshire (GB)

( * ) Notice: Subject to any disclaimer, the term of this patent is extended or adjusted under 35 U.S.C. 154(b) by 109 days.

(21) Appl. No.: 10/043,831

(22) Filed: Jan. 11, 2002

(65) Prior Publication Data

US 2002/0108337 A1 Aug. 15, 2002

(30) Foreign Application Priority Data

Jan. 11, 2001 (GB) ..... 0100759
Oct. 1, 2001 (GB) ..... 0123575

(51) Int. Cl.[7] ..... E06B 3/00; E06B 3/70; E06B 3/72; E06B 3/82

(52) U.S. Cl. ..... 52/802.11; 52/800.1; 52/784.15; 52/794.1; 52/309.9; 52/734.1; 52/745.15

(58) Field of Search ..... 52/309.9, 784.15, 52/455, 784.1, 794.1, 800.1, 800.12, 802.1, 802.11, 795.15, 730.3, 734.1, 656.2, 656.4, 800.13; 49/501, 162, 506

(56) References Cited

U.S. PATENT DOCUMENTS

| | | | | | |
|---|---|---|---|---|---|
| 3,357,146 | A | * | 12/1967 | Gartrell | |
| 3,546,841 | A | * | 12/1970 | Smith et al. | |
| 3,834,101 | A | * | 9/1974 | Wilder et al. | |
| 3,885,351 | A | * | 5/1975 | Imperial et al. | |
| 4,114,319 | A | * | 9/1978 | Governale | |
| 4,374,693 | A | * | 2/1983 | Pitt | |
| 4,441,301 | A | * | 4/1984 | Benson | |
| 4,752,517 | A | * | 6/1988 | Beitel | |
| 4,864,789 | A | * | 9/1989 | Thorn | 52/309.9 |
| 4,984,402 | A | | 1/1991 | Davies | |
| 5,074,087 | A | * | 12/1991 | Green | 52/309.9 |
| 5,289,657 | A | * | 3/1994 | Kiel | |
| 5,537,789 | A | | 7/1996 | Minke et al. | |
| 5,577,363 | A | * | 11/1996 | Tate et al. | 52/784.15 |
| 5,722,213 | A | * | 3/1998 | Morency | 52/784.11 |
| 5,839,252 | A | * | 11/1998 | Berghorn et al. | 52/784.13 |
| RE36,240 | E | | 6/1999 | Minke et al. | |
| 6,138,435 | A | * | 10/2000 | Kocher et al. | 52/800.1 |
| 6,311,454 | B1 | * | 11/2001 | Kempel | 52/784.15 |

FOREIGN PATENT DOCUMENTS

| | | | | | |
|---|---|---|---|---|---|
| DE | 85 11 971 | | | 7/1985 | |
| EP | 0747205 | A2 | | 12/1996 | |
| EP | 0902148 | A2 | | 3/1999 | |
| EP | 1223289 | | * | 7/2002 | E06B/3/70 |
| EP | 001298277 | A2 | * | 4/2003 | E06B/3/82 |
| GB | 2129475 | | | 5/1984 | |
| GB | 2183706 | A | | 6/1987 | |
| GB | 2186234 | | | 8/1987 | |
| GB | 2279682 | | | 1/1995 | |
| GB | 2313569 | | | 12/1997 | |
| GB | 2 315 292 | | | 1/1998 | |
| GB | 2334989 | | * | 8/1999 | E06B/3/72 |
| GB | 2334991 | | * | 8/1999 | E06B/3/72 |
| GB | 2393932 | A | * | 4/2004 | B29C/70/68 |
| WO | WO 01/02470 | A1 | | 1/2001 | |
| WO | WO 01/09472 | A1 | | 2/2001 | |

OTHER PUBLICATIONS

1999–230939, Jan. 1999, Derwent Abstrac.*

European Search Report—EP 1 223 289 A3—Jul. 17, 2003.

* cited by examiner

*Primary Examiner*—Robert Canfield
(74) *Attorney, Agent, or Firm*—Caesar, Rivise, Bernstein, Cohen & Pokotilow, Ltd.

(57) ABSTRACT

A door comprises a framework formed from lengths of pultruded synthetic material having a low coefficient of thermal expansion, the space defined by the framework may be at least partially occupied by a core comprising a body of synthetic, structural-density, foam material and skins may be secured to opposed faces thereof to leave edges of the framework exposed.

2 Claims, 3 Drawing Sheets

FIG.1
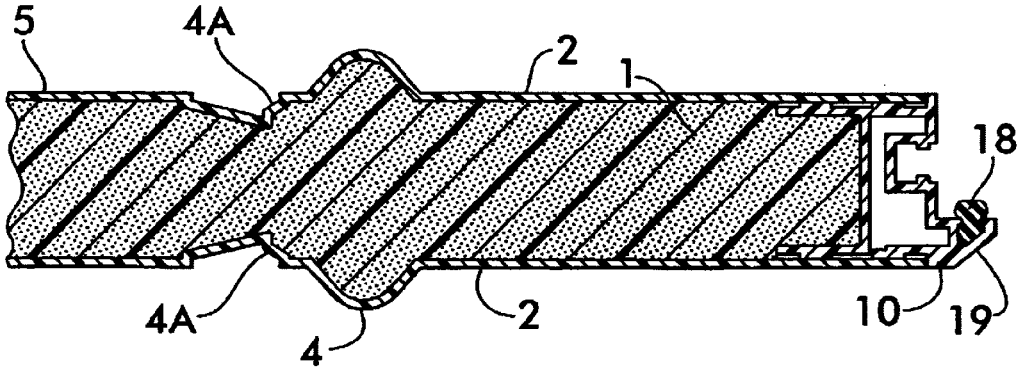
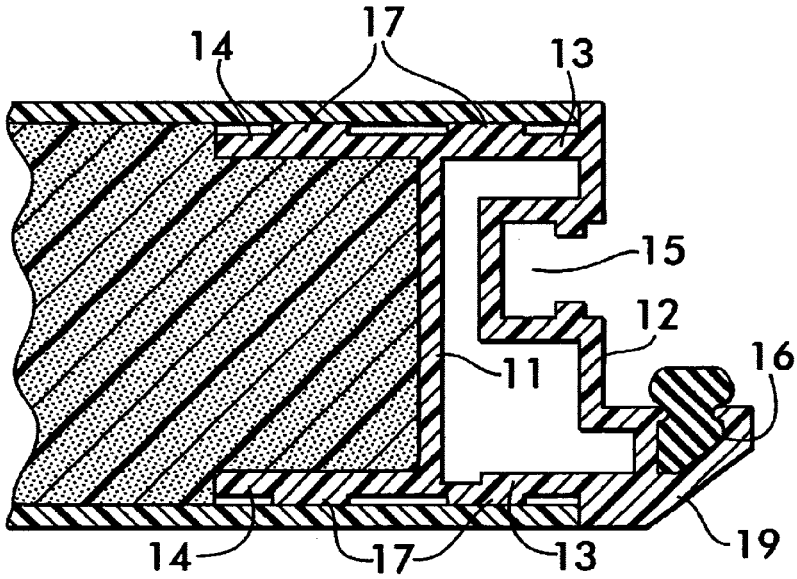
FIG.2

FIG.4A
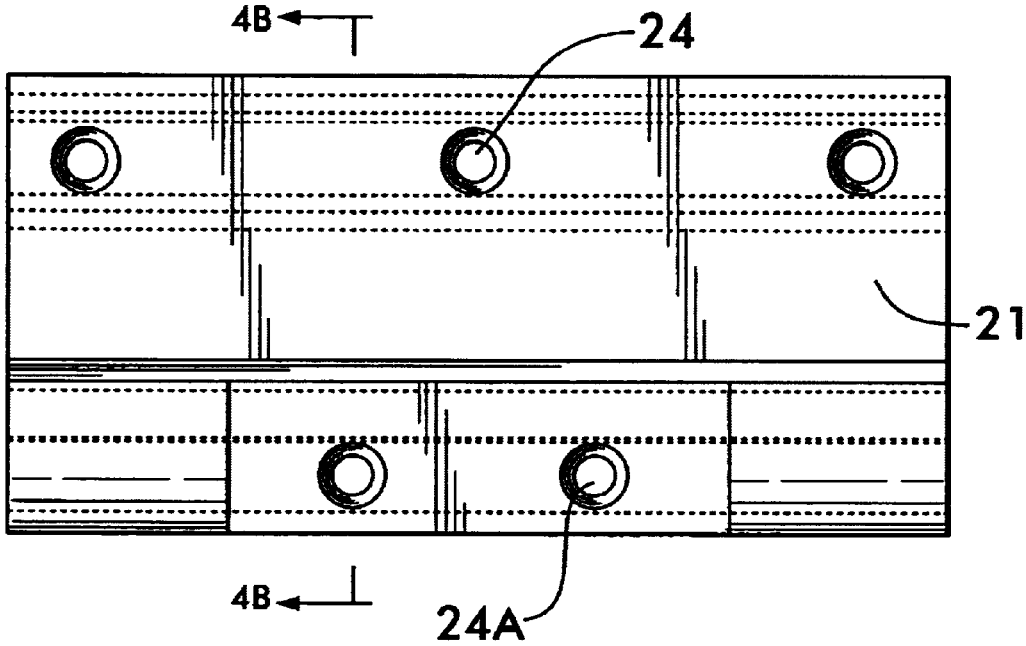
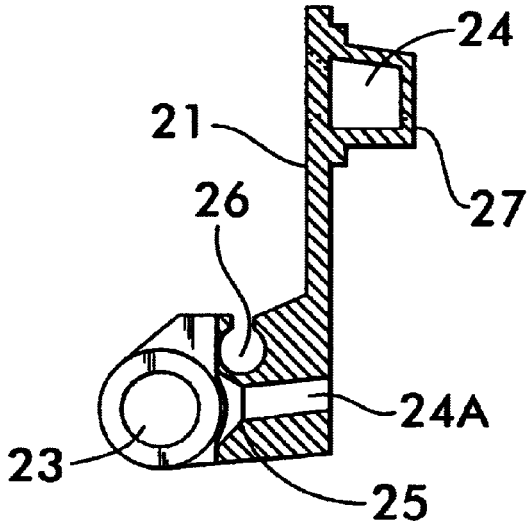
FIG.4B

DOORS

This invention relates to a door and, in particular, to a door for use in a building.

It been proposed to form architraves from solid, fibre-reinforced themoset substrates, each exposed surface of which has a protective thermoplastic compound bonded thereto. A length of substrate may be formed by pultrusion and may have a lineal core of omnidirectional fibres together with a peripheral mat of fibres. Such a component is not suitable for use as a door framework.

A modern door may be formed from solid wood although due to environmental and industrial processing concerns such doors are becoming less common. Other doors may comprise a plastics framework, generally rectangular as seen in elevation, the front (or outer) and rear (or inner) faces of which are covered by panels. A door of this general form is disclosed in GB 2279682.

The panels may have recesses for glass panes, letter-boxes and the like. The vertical edges of the door may have seals to exclude draughts in gaps between the door and the frame or architrave in which it is received.

It is one object of the invention to provide a door which can be manufactured easily and relatively cheaply. It is a further object of the invention to provide a door which may be configured for use as either an internal or an external door. A further object of the invention relates to the provision of a door which can have a suitable or desirable decorative finish.

A first aspect of the invention provides a door comprising a framework having skins secured to opposed faces thereof to leave edges of the framework exposed, the framework being formed from lengths of pultruded synthetic material having a low coefficient of thermal expansion.

Preferably the space defined between the skins and the framework is at least partially filled by a core comprising a body of synthetic, structural-density, foam material.

There is further provided, in a second aspect of the invention, a door comprising a framework formed from lengths of pultruded synthetic material having a low coefficient of thermal expansion, the space defined by the framework being at least partially occupied by a core comprising a body of synthetic, structural-density, foam material.

The door may further comprise skins secured to the framework by, for example, an adhesive, to leave edges thereof exposed and sandwiching between the foam material between the skins.

Preferably the lengths of pultruded synthetic material are hollow.

The lengths of pultruded synthetic material are formed from a thermoset resin in which elongate fibres are embedded. Preferably the fibres extend continuously along the lengths.

Preferably the framework is rectangular, having opposed top and bottom lengths and opposed side lengths. In a preferred embodiment, at least one of the side lengths comprises a base to contact an edge of the body and two side arms to extend from the base between the body and the skins, the outer face of the side arms being shaped to receive and retain set adhesive by which the skin and side length are held together.

The side arms may comprise spaced-apart ridges on their outer directed surfaces between which set adhesive is received and retained. The adhesive is cross-linked and, most preferably, is a cross-linked acrylate. The adhesive will comprise uncross-linked adhesive and an activator therefor, which are mixed just prior to use.

The base may also comprise an extension portion having a recess in which a weather seal is located or locatable. The extension portion preferably extends from one side of the body.

Each of the four lengths of pultruded synthetic material which provide the framework may comprises a base to contact an edge of the body and two side arms to extend from the base between the body and the skins, the outer face of the side arms preferably being shaped to receive and retain set adhesive by which the skin and side length may be held together.

A further aspect of the invention provides a framework for a door comprising four lengths to be arranged in sides to form a generally rectangular frame, the lengths comprising pultruded thermoset resin containing elongate fibres.

A fourth aspect of the invention provides a method of forming a door, the method comprising pultruding synthetic material having a low coefficient of thermal expansion to form lengths, assembling the lengths to form a framework, and attaching skins to opposed faces of the so-assembled framework.

A yet further aspect the invention provides a method of forming a door, the method comprising pultruding synthetic material having a low coefficient of thermal expansion to form lengths, assembling the lengths to form a framework, and at least partially filling the space defined by the framework with a core comprising a body of synthetic, structural-density, foam material.

A more specific aspect of the invention provides a method of making a door wholly composed of thermoset plastics, the method comprising forming a body of synthetic, structural-density foam material and connecting a length of pultruded synthetic material having a low coefficient of thermal expansion to one edge of the body, the length comprising two side walls extending from a base, an outer face of each side wall having spaced apart projections, attaching lengths of pultruded synthetic material having a low coefficient of thermal expansion to the other edges of the body to provide a peripheral framework, applying an adhesive to the side walls and then applying a skin to cover the frame and body and curing the adhesive to unite the skin to the framework.

Pultrusion is a process by which continuous elongate fibres e.g. glass, carbon or aramid, Terylene, Nylon and hemp are impregnated into a thermoset resin and, pulled through a preformer into a heated die. The shape of the end product is determined by the die and the heat causes the resin to polymerise, e.g. cross link. By using pultrusion, one can obtain lengths which can be cut to size and then joined together to form a frame. The lengths have a good strength/weight ratio. Because the frame lengths can be pultruded of thermoset material which has a low coefficient of thermal expansion, if the panels are made of a material having the same property, one can have a door the components of which will have a substantially uniform coefficient of thermal expansion. If the housing to receive the door is made of the same plastics then the entire assembly will expand and contract over temperature extremes at a uniform rate. This is especially important where the door is an external door subject to changes in ambient environmental conditions.

Suitable thermoset plastics include polyesters, vinylesters, epoxy and phenolic resins; and the like.

The skins may be made in any known way. The skins may be plain white or have a wood-grained effect or be pigmented or stained. Preferably at least one of the skins is a thermoset material with a low coefficient of thermal expansion.

If the door is intended to be used as an external door, the externally facing skin will preferably be formed from a thermoset material, which is able to withstand ambient environmental conditions, the internally facing skin may be formed from a thermoplastics material or may be formed from a thermoset material.

A suitable thermoset material is sheet moulding compound (SMC), formed by compression moulding and/or adhesive bonding to the framework.

In this specification, the term synthetic, structural-density foam material relates to a foam material with a density in excess of about 200 kg/m$^3$. The density can be much higher, say about 800 kg/m$^3$ and will typically be of the order of 250 to 400 kg/m$^3$. The density of these structural-density foam materials is such that cavities can be cut or formed therein to receive and accept items of door furniture such as locks, letter boxes and the like.

The synthetic, structural-density foam material may be made by foaming a plastics material such as a polyurethane or phenolic resin.

In order that the invention may be more fully understood it will now be described, by way of example only, and with reference to the accompanying drawings in which:

FIG. 1 is a horizontal section of one door of the invention;

FIG. 2 is an enlarged section of the chassis of the door of FIG. 1;

FIG. 4A is a plan view of a door hinge; and

FIG. 4B is a horizontal section taken on lines B—B on FIG. 4A.

Figure 3:
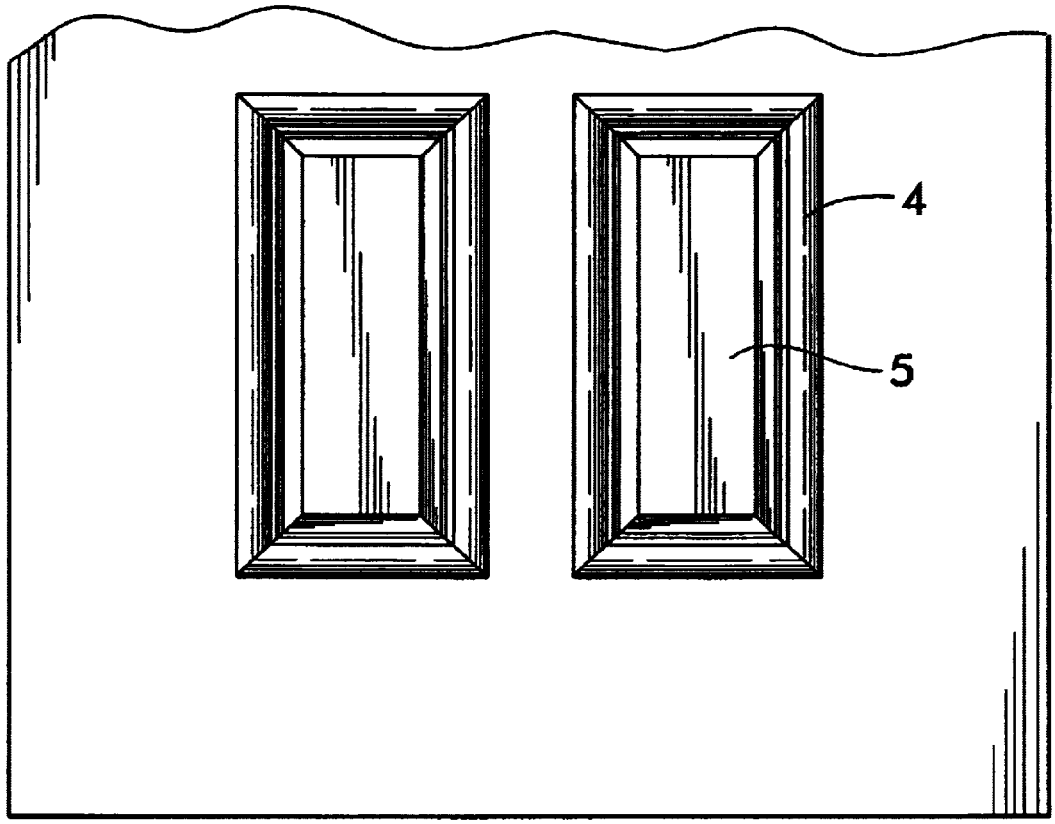
FIG. 3 is an elevation showing a part of the door of FIG. 1.

The door of FIG. 1 comprises a high-density thermoset polyurethane foam core 1, typically of a density of 250 kg/m$^3$. The thermoset plastics may be polyester, vinylester, epoxy or phenolic instead of the polyurethane. The door has compression moulded thermoset sheet moulding compound (SMC) skins 2 which are about 3 mm thick. A suitable SMC compound is that sold by Scott Bader Limited of Wellingborough, United Kingdom under the registered trademark Crystic Nupreg. Other suitable skin materials are pre-formed uPVC, or Glass-fibre Reinforced Plastics (GRP). The skins 2 extend across the entire face of the door.

At its' edge, the door has a pultruded door chassis 10 shown better in FIG. 2. The chassis 10 is a pultruded length of continuous glass fibre lengths in a thermoset material, usually a polyester although vinylesters, epoxy and phenolic resins may also be used.

As shown in FIG. 2, the chassis comprises a base 11 which contacts the edge of the core 1. The base has a roof 12 and these are separated by side-walls 13. The side-walls 13 have parallel extensions 14 going beyond the base 11. The roof 12 has a recess 15 extending along its entire length to receive an extension portion 27 of a hinge (see FIGS. 4A and B) or a lock assembly at an edge of the door opposite to that which takes a hinge. To one side of the recess 15 is a longitudinal extension 19 having a recess 16 to receive the weather seal 18. Spaced apart ridges 17 are present on the outer faces of the extension 14. The skins 2 are dimensioned to overlie the front and rear faces of the core 1, and at the sides of the door, the extensions 14 of the edge chassis. The ridges 17 define with the skins 2, grooves down or along which self-setting adhesive is applied to secure the skin to the core. The adhesive preferred is an acrylate composition which is activated immediately before use. The core 1 is rebated in the region adjacent the extensions 14. The rebated region may be machined out or may be formed during the formation of the core 1.

The edge chassis members which provide the top and bottom of the framework are identical to that shown in FIGS. 1 and 2. The four lengths may be joined together by interlocking parts, by welding and/or by adhesives.

The recess 15 of the top and bottom edge chassis members can receive a portion of a door closer and an additional weather seal respectively. The weather seal 18 can extend around the entire periphery of the edge chassis in the recesses 16 associated with each of the edge chassis members.

The door, as shown in FIG. 1, has a raised portion 4 which defines the perimeter of a panel 5, as is best indicated in FIG. 3.

The panel 5 is recessed with respect to the rest of the door and may be cut out to allow for a glazing panel, for example, to be installed. The panel 5 is sized such that a standard glazing panel with its associated peripheral beading is locatable within the aperture left with the beading being retained in the space defined by terminal edges 4A of the raised portion 4.

The door is particularly effective because, being all plastics, it is weatherproof and will not decay or rot. Whilst the above description states that both skins 2 are formed from a thermoset material, only one may be, the other being formed from a thermoplastics material. In that case, the skin 2 which is to face the harshest conditions (usually that which is to face the outside) is the thermoset skin 2.

The door may be mounted in a frame using any suitable hinge. Preferably, however, the hinge is that according to FIGS. 4A and 4B and has a plate 21 joined to another (not shown) at a common edge defining a socket to receive the hinge pin 23. The plate 21 has spaced apart screw holes 24 one of which extends through extension portion 27. According to this invention, the plate 21 has an extension 25 facing one side of the hinge pin 23, and a screw hole 24A to receive a screw. At one side the extension 25 has a slot 26 to receive a weather seal. When the hinge of FIGS. 4A and 4B is to be installed, the extension portion 19 of the door chassis 10, in that region is machined back, so as to be flush with the base 12. The hinge plate 21 is then attached to the base 12 providing a continuous recess 16, 26 along the entire length of the chassis for a weather seal 18. By disposing the seal 18 in this position the seal becomes very effective when the door is closed. By disposing the screw hole 24A where shown, it is well protected by the hinge pin 23. The other plate (not shown) is joined to the plate 21 by inserting a hinge pin through their common aligned apertures (defining the socket). Screws are inserted through holes in the plate and into the frame of the door, thereby suspended or hanging the door from the frame.

The use of pultruded lengths in the framework is particularly advantageous because a thermoset material such as polyester has a low coefficient of thermal expansion. When suitable thermoset structural density foams are used as the core material and SMC is used as the skin, the door of the invention, when used as an external door will not change in dimensions significantly irrespective of the ambient conditions. Cracking and delamination is avoided.

What is claimed is:

1. A door comprising a thermoset framework formed from lengths of pultruded, synthetic, thermoset material, said framework defining a space at least partially occupied by a core comprising a body of synthetic, structural-density, thermoset foam material having a density in excess of 200 kg/m$^3$, wherein the framework is rectangular, said door including thermoset plastic skins extending across opposed faces of said body of synthetic, structural-density, thermoset foam material and said framework, said framework having top and bottom lengths and opposed side lengths, at least one of said side lengths comprising a base contacting an edge of said foam material and two side arms extending in opposed directions from said base, portions of said side arms extending in one direction from said base being disposed between said body of synthetic, structural-density, thermoset foam material and said skins, said skins extending in overlying relationship with portions of said side arms extending in said other of said directions from said base, and wherein an outer face of said side arms extending in both directions from said base including recesses for receiving and retaining set adhesive by which said skins, body of thermoset foam material and said side lengths are held together.

2. A method of forming a door wholly composed of thermoset plastics, the method comprising the steps of: forming a body of synthetic, structural-density, thermoset foam material having a density in excess of 200 kg/m$^3$ and connecting a length of pultruded, synthetic, thermoset material to one edge of the body, the length comprising two side walls having sections extending in opposed directions from a base, an outer face of each side wall located on each side of the base having spaced apart projections providing recesses for receiving adhesive therein, said base overlying said one edge of the body with sections of the two side walls extending in one direction from said base overlying side walls of said body, attaching lengths of pultruded, synthetic, thermoset material to the other edges of the body to provide a peripheral framework, applying an adhesive within the recesses provided between the spaced apart projections in the sections of the side walls located on each side of the base and then applying a skin of thermoset material overlying said adhesive to cover outer faces of said side wall including said adhesive on both sides of the base and curing the adhesive to unite the skin to the framework and cover said body.

* * * * *